US011426745B1

(12) United States Patent
Schlueter et al.

(10) Patent No.: US 11,426,745 B1
(45) Date of Patent: Aug. 30, 2022

(54) TURBINE DRIVEN CHEMICAL DISPENSER

(71) Applicant: Dema Engineering Company, St. Louis, MO (US)

(72) Inventors: James Michael Schlueter, Defiance, MO (US); Michael Lee Huegerich, St. Louis, MO (US); Sone Justin Chan, St. Louis, MO (US)

(73) Assignee: Dema Engineering Company, St. Louis, MO (US)

( * ) Notice: Subject to any disclaimer, the term of this patent is extended or adjusted under 35 U.S.C. 154(b) by 134 days.

(21) Appl. No.: 16/829,734

(22) Filed: Mar. 25, 2020

Related U.S. Application Data

(60) Provisional application No. 62/823,290, filed on Mar. 25, 2019.

(51) Int. Cl.
*B05B 7/24* (2006.01)
*B67D 7/74* (2010.01)
*B01F 25/312* (2022.01)

(52) U.S. Cl.
CPC ..... *B05B 7/2443* (2013.01); *B01F 25/312* (2022.01); *B67D 7/741* (2013.01)

(58) Field of Classification Search
CPC ..... B05B 7/2443; B01F 5/0413; B67D 7/741
See application file for complete search history.

(56) References Cited

U.S. PATENT DOCUMENTS 5,344,619 A * 9/1994 Larwick ..... B01F 1/00 366/163.2
2003/0056841 A1* 3/2003 Dalhart ..... B01F 3/0865 137/889
2020/0002151 A1* 1/2020 Kraus ..... B67D 3/0058

FOREIGN PATENT DOCUMENTS

GB 1208563 A * 10/1970 ..... G05D 11/132

* cited by examiner

*Primary Examiner* — Jason K Niesz
(74) *Attorney, Agent, or Firm* — Husch Blackwell LLP

(57) ABSTRACT

A chemical dispensing device includes a turbine having a diluent inlet and a diluent outlet; a pump having a chemical inlet and a chemical outlet, wherein the pump is connected with and actuated by rotation of the turbine; a mixing chamber having a mixing inlet and a mixing outlet; wherein the diluent inlet is configured for direct connection with a supply of pressurized diluent; wherein the pump inlet is configured for connection with a supply of chemical concentrate; wherein the diluent outlet and chemical outlet are in fluid communication with the mixing inlet of the mixing chamber. The chemical dispensing device of the present disclosure may further include a backflow preventer separating the diluent outlet from the mixing inlet and being configured to prevent flow of fluid from the mixing chamber to the diluent outlet. An associated method of diluting and dispensing a chemical concentrate is also described.

8 Claims, 6 Drawing Sheets

TURBINE DRIVEN CHEMICAL DISPENSER

CROSS REFERENCES

This application claims the benefit and priority of U.S. Provisional Patent Application Ser. No. 62/823,290 filed Mar. 25, 2019, the entire disclosure of which is hereby incorporated herein by reference.

FIELD OF INVENTION

The present invention relates generally to chemical dispensing and mixing devices used to mix and dilute bulk chemicals into usable product portions and, more specifically, to a device allowing for a bulk chemical to mix with a diluent, in a desired ratio, without having to measure the chemical or diluent.

BACKGROUND

Commercial and industrial cleaning chemicals are frequently packaged in concentrated form. Prior to use, the concentrated chemical is then diluted with water. Venturi-based devices are often used to dilute a chemical concentrate due to their cost effectiveness. However, the accuracy of diluting the chemical concentrate depends on the water pressure and water flow, which can vary between each facility or even the location within each facility. The accuracy of dilution can also vary due to the variability of metering orifices in dispensers, which can be difficult to precisely manufacture due to the precision needed since the ratio of dilution is usually controlled by restricting the flow rate of the chemical concentrate through the orifice. These metering orifices can also often become either partially or completely blocked due to the solidification of the chemical concentrate on the orifice. Finally, venturi-based chemical dispensers may use integrated elastomeric gap backflow devices to prevent the chemical from entering the water supply. However, local jurisdictions may not accept the use of some integrated elastomeric gap backflow devices. Therefore, some venturi-based chemical dispensers use air gaps instead to prevent backflow, but venturi-based chemical dispensers with integrated air gaps may have a reduction or elimination of vacuum when exposed to poor water conditions. Thus, the chemical dispenser can no longer draw up the chemical concentrate at the same rate, and the accuracy of the chemical concentrate dilution is therefore altered and the cleaning efficacy is reduced.

SUMMARY OF THE INVENTION

This section provides a general summary of the disclosure, and is not a comprehensive disclosure of its full scope or all of its features.

According to one aspect of the present disclosure, there is provided a chemical dispensing device that includes a turbine having a diluent inlet and a diluent outlet; a pump having a chemical inlet and a chemical outlet, wherein the pump is connected with and actuated by rotation of the turbine; a mixing chamber having a mixing inlet and a mixing outlet; wherein the diluent inlet is configured for direct connection with a supply of pressurized diluent; wherein the pump inlet is configured for connection with a supply of chemical concentrate; wherein the diluent outlet and chemical outlet are in fluid communication with the mixing inlet of the mixing chamber.

According to a further aspect of the present disclosure, there is provided a chemical dispensing device that includes a turbine having a diluent inlet and a diluent outlet; a pump having a chemical inlet and a chemical outlet, wherein the pump is connected with and actuated by rotation of the turbine; a mixing chamber having at least one mixing inlet and a mixing outlet; a direct connection between the diluent inlet and an outlet of the supply of pressurized diluent wherein pressurized diluent flows directly from the outlet of the supply of pressurized diluent into the diluent inlet; wherein the pump inlet is configured for connection with a supply of chemical concentrate; wherein the diluent outlet and chemical outlet are in fluid communication with the mixing inlet of the mixing chamber; and at least one backflow preventer separating the diluent outlet from the at least one mixing inlet and being configured to prevent backflow of fluid from the mixing chamber to the diluent outlet.

According to yet another aspect of the present disclosure, there is also provided an associated method of diluting and dispensing a chemical concentrate, comprising the steps of: providing a turbine having a diluent inlet and a diluent outlet, the diluent inlet being configured for direct connection with a supply of pressurized diluent; providing a pump having a chemical inlet and a chemical outlet, the chemical inlet being configured for connection with a supply of chemical concentrate; and mechanically connecting the turbine with the pump to allow the pump to be driven by operation of the turbine when diluent flows through the turbine; providing a mixing chamber having at least one mixing inlet and a mixing outlet, wherein diluent from the diluent outlet of the turbine and chemical concentrate from the chemical outlet of the pump separately flow into the at least one mixing inlet of the mixing chamber.

Further aspects and areas of applicability will become apparent from the description provided herein. It should be understood that various aspects of this disclosure may be implemented individually or in combination with one or more other aspects. It should also be understood that the description and specific examples herein are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION OF THE INVENTION

Figure 1:
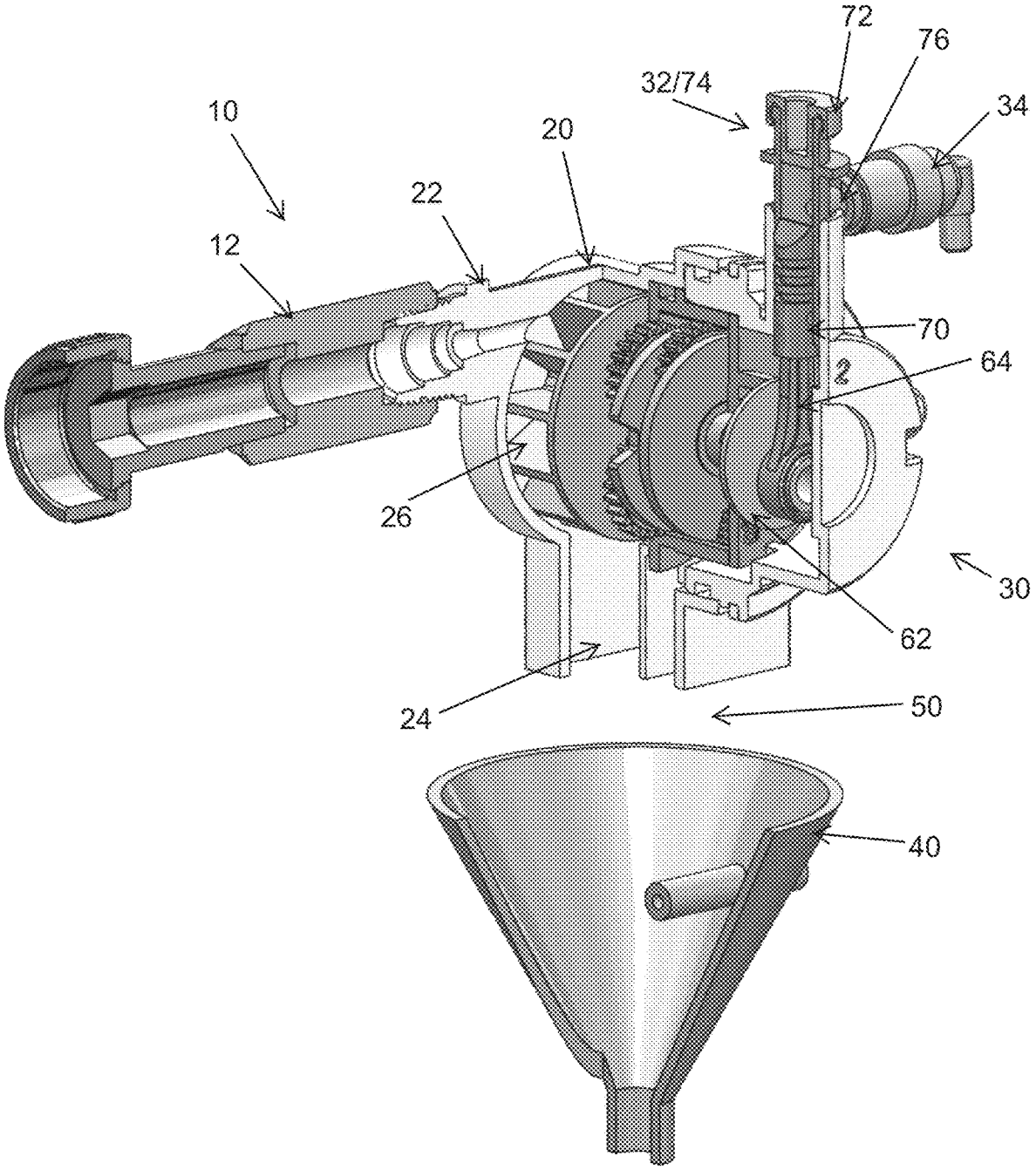
FIG. 1 is a cutaway perspective view of a first embodiment of a dispensing device in accordance with the teachings of the present disclosure.

Example embodiments will now be described more fully with reference to the accompanying drawings.

Example embodiments are provided so this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The methods, processes, and operations described herein are not to be construed as necessarily requiring their performance in the particular order discussed or illustrated, unless specifically identified as an order of performance. It is also to be understood that additional or alternative steps may be employed.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another element, component, region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
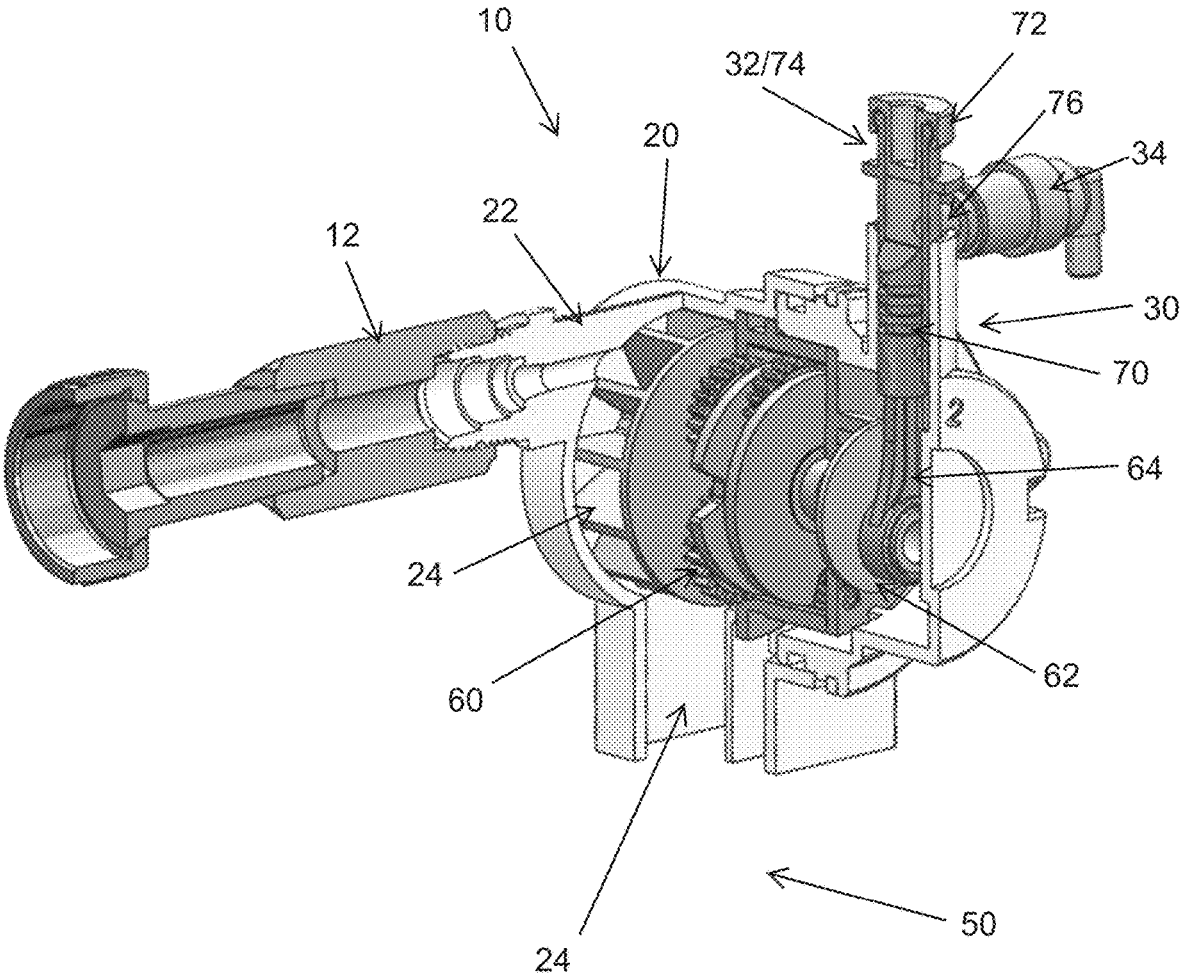
FIG. 2 is an enlarged view of the internal components of the embodiment of FIG. 1.
Figure 3:
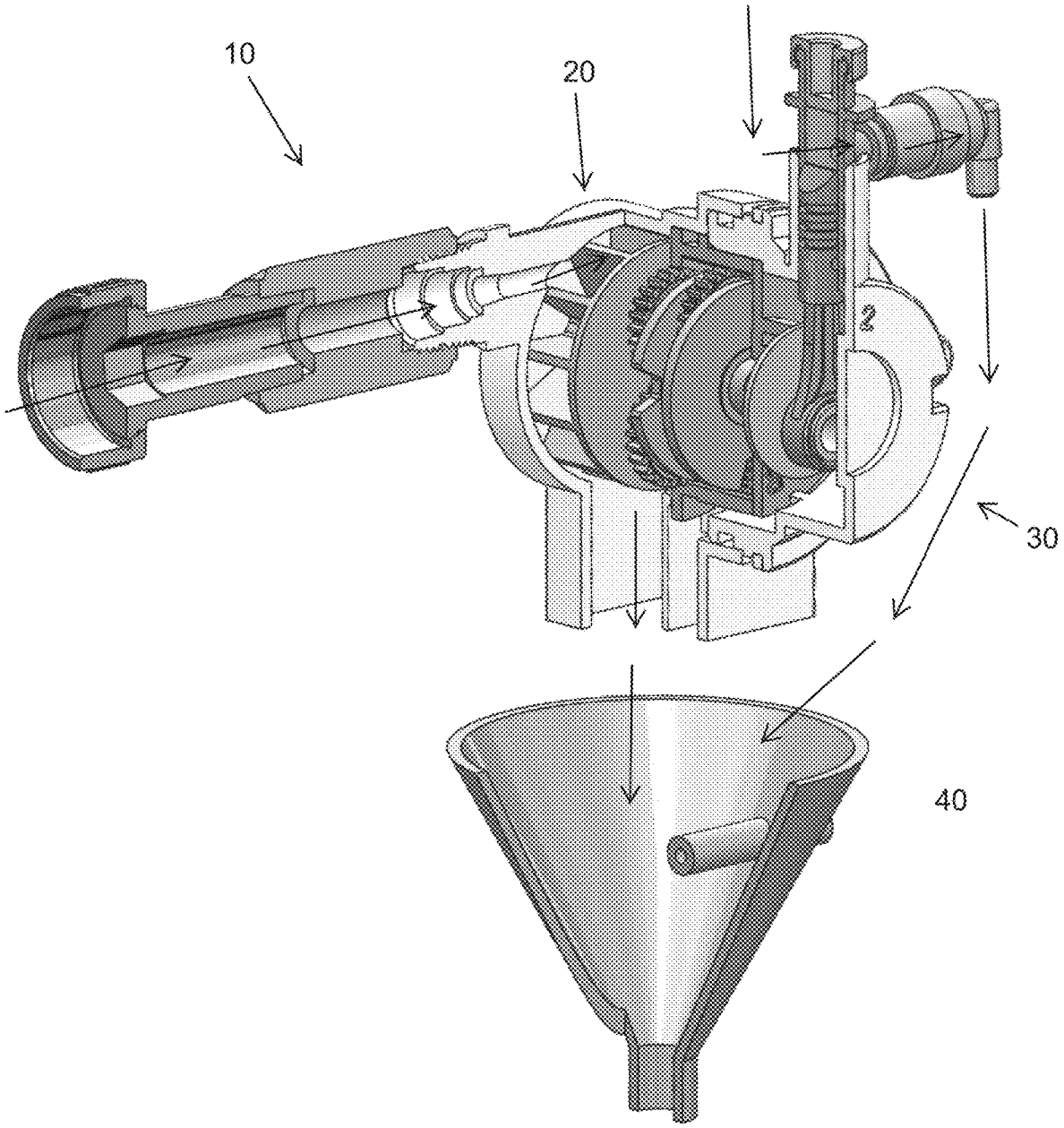
FIG. 3 is a schematic illustrating an exemplary flow path of water and chemical concentrate through the embodiment of FIGS. 1 and 2.

FIGS. 1-3 illustrate a first embodiment of a chemical dispensing device 10 that may be selectively connected with a bulk chemical concentrate container (not shown) and a supply of pressurized water (not shown), for example a hose connected with a hose bib, faucet, or the like. The dispensing device 10 includes a turbine 20 having a water inlet 22 and a water outlet 24, a chemical pump 30 having a chemical inlet 32 and a chemical outlet 34, and a mixing chamber 40. The water inlet 22 may be selectively connected with the supply of pressurized water, while the chemical pump inlet 32 may be selectively connected with the bulk chemical concentrate container. The chemical concentrate is drawn from the chemical container into the dispensing device 10 where the chemical concentrate is mixed with water at a desired ratio.

The water inlet 22 may be provided with a water flow valve 12, for example a push button on/off valve, ball valve, gate valve, solenoid valve, or a similar device, in certain embodiments in order to allow the flow of water through the dispenser 10 to be selectively interrupted. The valve 12 allows for selective control of the flow of water through the dispensing device 10.

The water inlet 22 provides a fluid flow path into the turbine 20. A pressurized flow of water flows through the water inlet 22 and into the turbine 20 where it impinges on and imparts a force on a series of vanes 26 within the turbine 20, resulting in rotation of the turbine 20. After passing through the turbine 20, the flow of water exits the turbine 20 through the water outlet 24. In one embodiment, the turbine 20 may be an impulse turbine. In alternative embodiments, the turbine 20 may be a different type of turbine, such as a reaction type turbine.

The turbine water outlet 24 is further in fluid communication with a backflow preventer 50. In the illustrated embodiment of FIGS. 1-3, the backflow preventer 50 is an air gap created by separating the turbine water outlet 24 from the mixing chamber 40. The backflow preventer 50 permits one-way flow of fluid and ensures that the mixed water/chemical fluid that is created in the mixing chamber 40 does not backflow through the dispensing device 10 to the water supply. While an air gap is shown in the illustrated embodiment, it is contemplated within the scope of the present disclosure that there may be embodiments in which alternative backflow prevention devices, such as an elastomeric gap, are used or a backflow preventer is not present if not required by applicable plumbing codes.

In the illustrated embodiment, the turbine 20 is further mechanically connected to a gear set 60. The gear set 60 may be used to adjust the speed and torque produced at the turbine as needed for the desired or required operational characteristics of the chemical pump 30. The gear set 60 may be altered or replaced depending on the desired gearing ratio. The gear set 60 may be provided with an eccentric gear 62 at its output side as the first linkage in translating the rotational movement of the turbine 20 and gear set 60 to linear movement when the chemical pump 30 is a piston pump. The eccentric gear 62 may be provided with a central input shaft on a first side and an offset output shaft on a second side. The eccentric gear 62 would not be necessary in embodiments utilizing a rotational pump, for example. Further, the gear set 60 may be eliminated entirely if the output rotation of the turbine 20 is suitable as is to drive the associated chemical pump 30.

In those embodiments utilizing a piston pump, the output end of the gear set 60 or turbine 20 is pivotally connected with the proximal end of a connecting rod 64. The connecting rod serves as the second linkage involved in translating the rotational movement of the turbine 20 and gear set 60 to linear movement for operation of the chemical pump 30. The distal end of the connecting rod 64 is further pivotally connected with a piston 70 for the chemical pump 30. The pivoting connection between the connecting rod 64 and the piston 70 is the third and final transitional linkage between the gear set 60 or turbine 20 and the chemical pump 30.

The piston 70 reciprocates within a piston cylinder 72. The piston cylinder 72 may be oriented in any direction, for example, vertically or horizontally or at an angle, depending on factors such as desired housing size and orientation of the device 10. For the purpose of illustrating operation of the chemical pump 30 herein, the pump 30 will be assumed to be oriented in a vertical position and the directions used below will correspond to that particular orientation. The chemical inlet 32 and chemical outlet 34 allow for a flow of chemical concentrate in to and out of the piston cylinder 72. The piston 70 may be provided with one or more seals, such as a piston ring or O-ring, that create a seal between the piston 70 and piston cylinder 72 to minimize or prevent the flow or leakage of chemical concentrate past the piston 70 during operation of the chemical pump 30.

The reciprocating motion of the piston 70 within the piston cylinder 72 away from the distal end of the piston cylinder 72—thereby enlarging the open internal space within the cylinder 72—draws chemical concentrate from the chemical inlet 32. Movement of the piston 70 toward the distal end of the piston cylinder 72—thereby compressing the open internal space within the cylinder 72—forces chemical concentrate out of the cylinder 72 and through the chemical outlet 34. This desired flow of chemical concentrate through the pump 30—in through the chemical inlet 32 and out through the outlet 34—is facilitated by one-way check valves 74, 76 located at the chemical inlet 32 and outlet 34. The inlet check valve 74 allows fluid to flow through the inlet 32 in response to a reduction of pressure within the cylinder 72 during the down stroke of the piston 70 and closes to prevent any backflow of chemical concentrate through the inlet 32 during the upstroke of the piston 70, which increases pressure within the cylinder 72. Similarly, the outlet check valve 76 prevents the flow of fluid through the outlet 34 into the cylinder 72 during the down stroke of the piston 70 and allows fluid to flow out of the cylinder 72 through the outlet 34 during the upstroke of the piston 70.

Components of the chemical pump 30 may be adjusted to provide for the desired metered amount of chemical concentrate to be delivered by the pump 30 by changing the volume of the pump 30. For example, the diameter of the piston 70, and the corresponding diameter of the cylinder 72 may be enlarged or reduced. The length of the cylinder 72 may also be adjusted to be longer or shorter, and the length of travel of the piston 70 changed accordingly. It should be understood that the chemical pump 30 described above is a volumetric displacement pump. Various other forms of metering pumps may be incorporated into the device 10 however. It should be noted that the connection of the turbine 20 and the metering pump 30 produces a proportional operation of the turbine 20 and metering pump 30 regardless of the pressure or rate of flow of water through the turbine 20, which helps ensure a consistent ratio of water and chemical concentrate flowing through the turbine 20 and chemical pump 30, respectively.

The pump outlet 34 may be connected with and in fluid communication with a hose or other connection (not shown) that extends from the pump outlet 34 to the mixing chamber 40. In alternate embodiments, the pump outlet 34 may be positioned relative to the mixing chamber 40 such that chemical concentrate is allowed to flow directly from the pump outlet 34 to the mixing chamber 40. While the connection between the pump outlet 34 and the mixing chamber 40 may also incorporate an air gap or other backflow preventer, for example, an elastomeric gap, if desired, for example using the same air gap or elastomeric gap as discussed above in connection with the turbine 20, embodiments of the present disclosure may not be provided with a backflow preventer at this location. The association of a backflow preventer 50 with the flow of water from the turbine 20 is more important to the disclosure herein.

Chemical concentrate flowing to the mixing chamber 40 from the pump 30 may encounter water flowing from the turbine outlet 24 and be mixed within the mixing chamber 40 before exiting the mixing chamber 40 as a chemical diluted to the desired ratio for use. The chemical concentrate and water may enter the mixing chamber 40 through the same or different fluid inlets. Various output options from the mixing chamber 40 may be used, including a simple open orifice, a tube connection, an on/off or other form of fluid flow control valve. Further, the mixing chamber 40 may incorporate baffles or other structures in its interior to further facilitate thorough mixing of the chemical concentrate and water.

Figure 4:
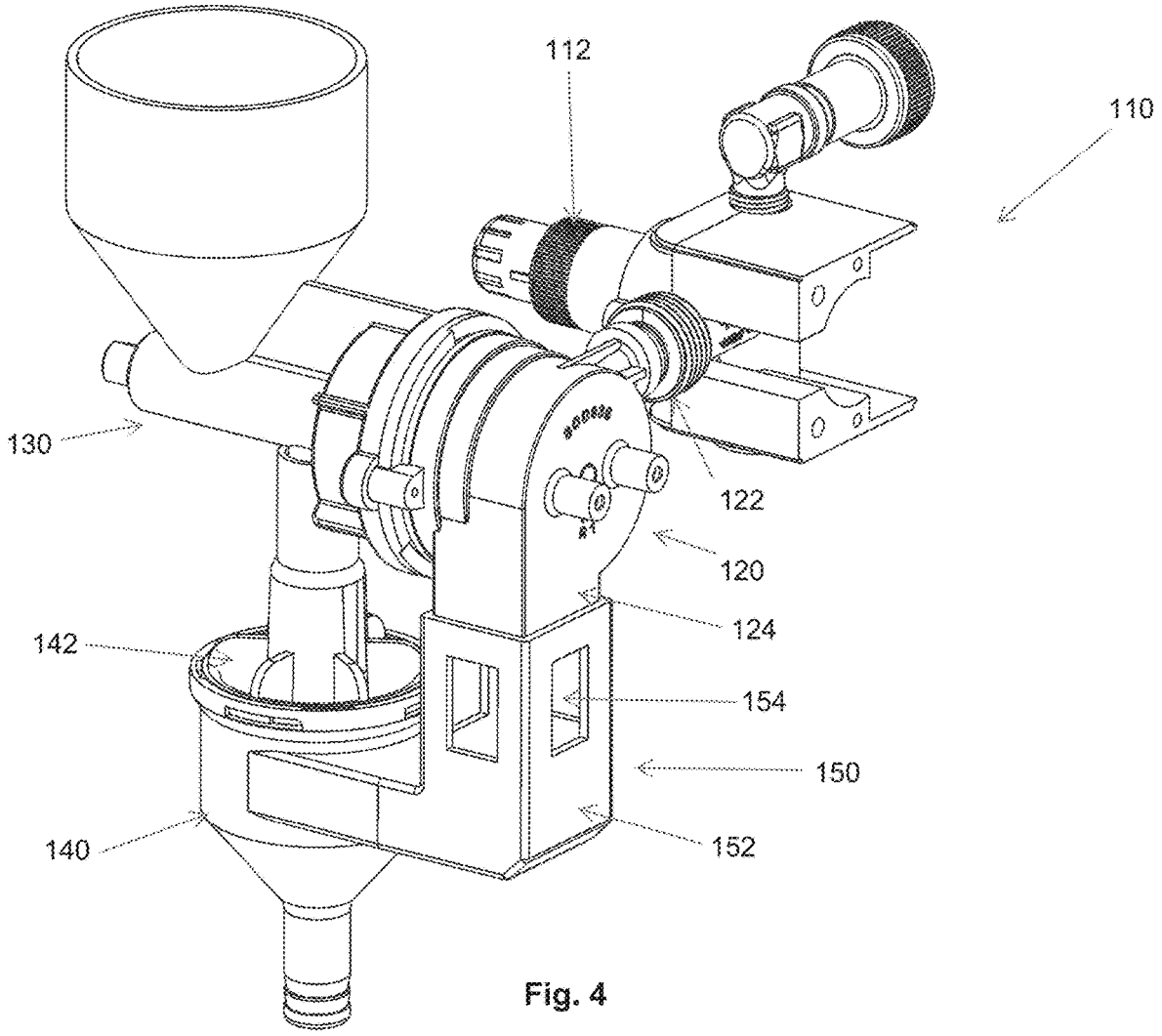
FIG. 4 is a perspective view of a second embodiment of a dispensing device in accordance with the teachings of the present disclosure.
Figure 5:
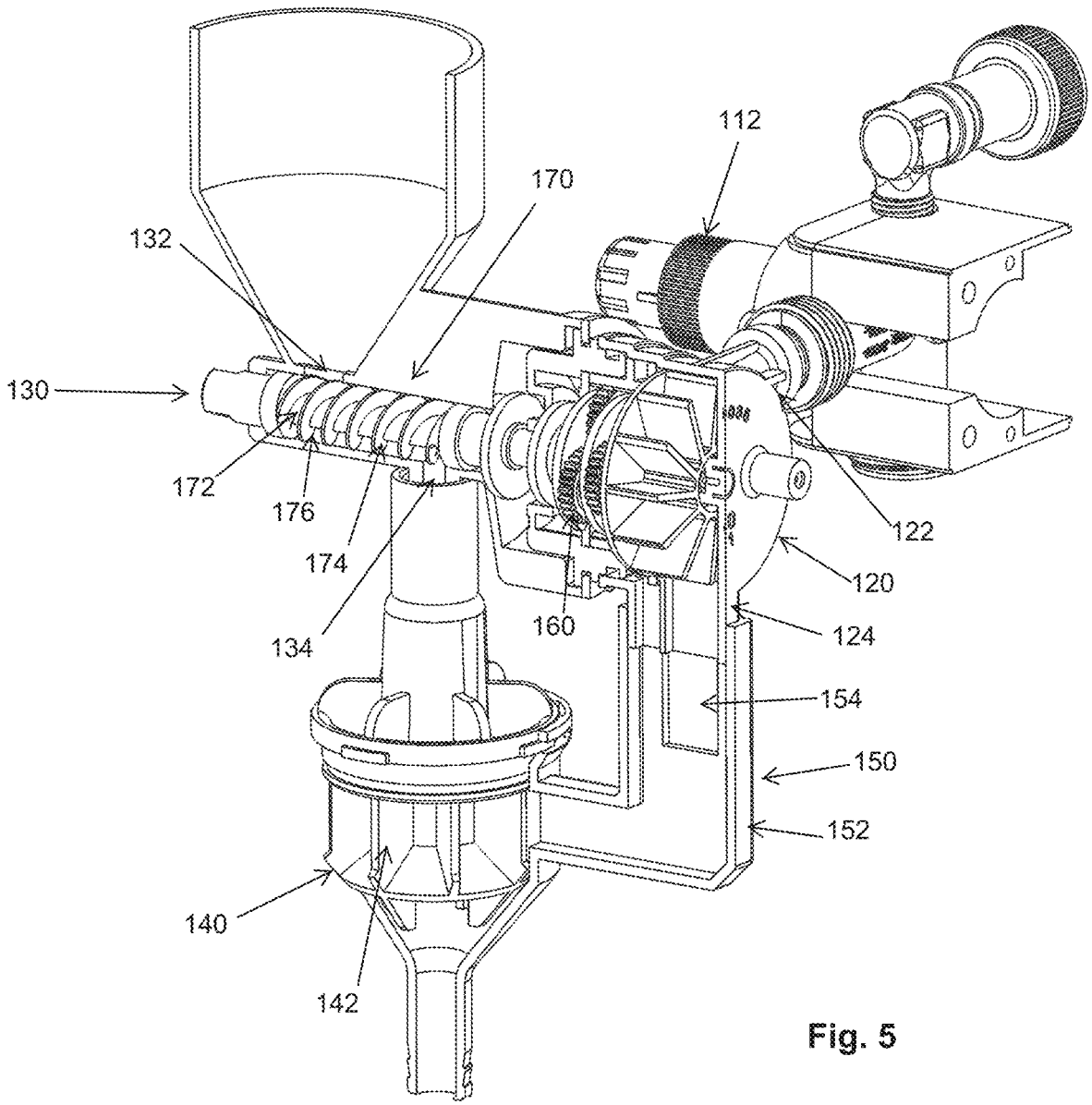
FIG. 5 is a cutaway perspective view of the embodiment of FIG. 4.
Figure 6:
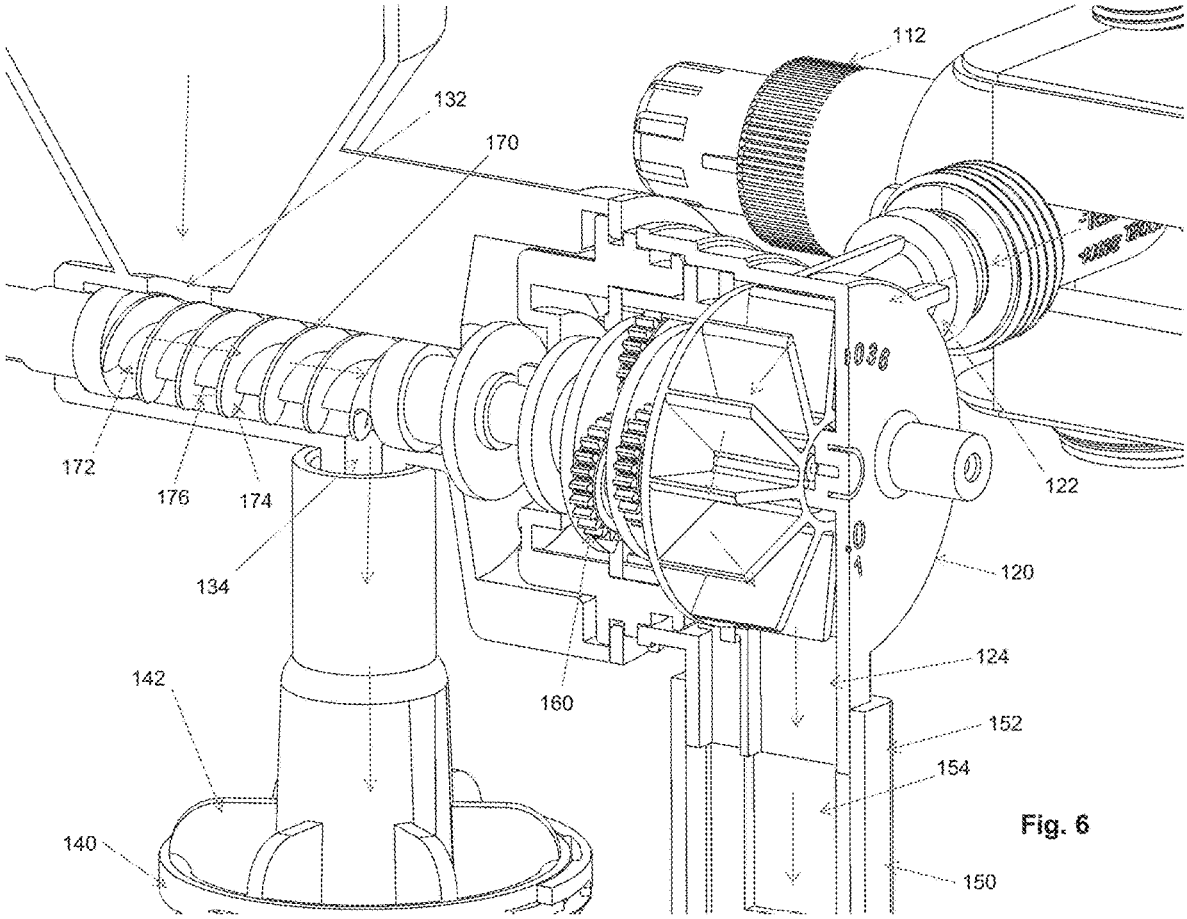
FIG. 6 is an enlarged view of the internal components of the embodiment of FIGS. 4 and 5 and also shows an exemplary flow path of water and chemical concentrate.

A second embodiment of a chemical dispensing device 110, used with chemical granules, pellets, or other solid forms (instead of a liquid chemical concentrate), is shown in FIGS. 4-6. This embodiment shares many similar components with the other embodiments described herein. More particularly, the device 110 may be selectively connected with a bulk chemical concentrate container (not shown) and a supply of pressurized water (not shown), for example a hose connected with a hose bib, faucet, or the like. The dispensing device 110 includes a turbine 20 having a water inlet 122 and a water outlet 124, a chemical pump 130 having a chemical inlet 132 and a chemical outlet 134, and a mixing chamber 140. The water inlet 122 may be selectively connected with the supply of pressurized water, while the chemical inlet 132 may be selectively connected with the bulk chemical concentrate container. The chemical concentrate is drawn from the chemical container into the dispensing device 110 where the chemical concentrate is mixed with water at a desired ratio.

The water inlet 122 may be provided with a water flow valve 112, for example a push button on/off valve, ball valve, gate valve, solenoid valve, or a similar device, in certain embodiments in order to allow the flow of water through the dispenser 110 to be selectively interrupted. The valve 112 allows for selective control of the flow of water through the dispensing device 110.

The water inlet 122 provides a fluid flow path into the turbine 120. A pressurized flow of water flows through the water inlet 122 and into the turbine 120 where it impinges on and imparts a force on a series of vanes 126 within the turbine 120, resulting in rotation of the turbine 120. After passing through the turbine 120, the flow of water exits the turbine 120 through the water outlet 124. In one embodiment, the turbine 120 may be an impulse turbine. In alternative embodiments, the turbine 120 may be a different type of turbine, such as a reaction type turbine.

The turbine outlet 124 is further in fluid communication with a backflow preventer 150. In the preferred embodiment illustrated in FIGS. 4-6, the backflow preventer 150 is an air gap created by separating the turbine water outlet 124 from the mixing chamber 140. The air gap 150 permits one-way flow of fluid and ensures that the mixed water/chemical fluid that is created in the mixing chamber 140 does not backflow through the dispensing device 110 to the water supply. In the illustrated embodiment, the air gap 150 is contained within a conduit 152 that is interrupted by one or more windows 154. While an air gap is shown in the illustrated embodiment, it is contemplated within the scope of the present disclosure that there may be embodiments in which alternative backflow prevention devices are used or a backflow preventer is not present if not required by applicable plumbing codes.

In the illustrated embodiment, the turbine 120 is further mechanically connected to a gear set 160. The gear set 160 may be used to adjust the speed and torque produced at the turbine as needed for the desired or required operational characteristics of the chemical pump 130. The gear set 160 may be altered or replaced depending on the desired gearing ratio. Further, the gear set 160 may be eliminated entirely if the output rotation of the turbine 120 is suitable as is to drive the associated chemical pump 130.

The output side of the gear set 160 or turbine 120 is connected with and drives rotation of an auger 170 within the chemical pump 130. Chemical concentrate is gravity-fed into the inlet 132 of the pump 130 where the auger 170 meters and advances the chemical toward the outlet 134. Chemical concentrate flowing to the mixing chamber 140 from the pump outlet 134 encounters water flowing from the turbine outlet 124 and is mixed with the mixing chamber 140 before exiting the mixing chamber 140 as a chemical diluted to the desired ratio for use. Various output options from the mixing chamber 140 may be used, including a simple open orifice, a tube connection, an on/off or other form of fluid flow control valve. Further, the mixing chamber 140 may incorporate baffles 142 or other structures in its interior to further facilitate thorough mixing of the chemical concentrate and water.

In the illustrated embodiment, the chemical pump 130 is a screw-type auger 170 with a central shank 172 with a helical screw blade 174 that spirals around the shank 170. Chemical concentrate granules are carried within troughs 176 in the helical screw blade 174 from the input 132 of the pump 130 to the output 134 of the pump 130 as the auger 170 rotates. The blade 174 pushes the chemical granules along the auger 170 and towards the granular chemical outlet 134. The chemical granules continue to move along the auger 170 until the chemical granules are dispensed through the granular chemical outlet 134 into the mixing chamber 140.

The speed of the auger 170 is linearly proportional to the turbine 120 speed and determined by the rate of water flow through the turbine 120, creating the desired chemical dilution rate at any water pressure and flow rate. The dilution ratio of the chemical granules and water may be altered by changing the ratio of the gear set 160 and/or the blade 174 height and separation of the auger 170.

Thus, the combination of elements in various embodiments eliminates the need for a user to measure either the amount of water or chemical concentrate, while still allowing the user to obtain the desired dilution ratio. Embodiments of the device may also eliminate the need for a user to come into direct contact with chemical concentrate. The dispensing devices also allow for a direct water supply connection.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A chemical dispensing device comprising:

a turbine having a diluent inlet and a diluent outlet;

a pump having a chemical inlet and a chemical outlet, wherein the pump is connected with and actuated by rotation of the turbine;

a mixing chamber having at least one mixing inlet and a mixing outlet;

a vertical gap separating the diluent outlet from the mixing inlet;

wherein the diluent inlet is configured for direct connection with a supply of pressurized diluent;

wherein the pump inlet is configured for connection with a supply of chemical concentrate; and wherein the pressurized diluent is directed through the turbine and the chemical concentrate is directed through the pump and wherein the pressurized diluent is subsequently gravity fed through the vertical gap to the at least one mixing inlet of the mixing chamber.

2. The chemical dispensing device as set forth in claim 1, further comprising a gear set mechanically linking the turbine and the pump.

3. The chemical dispensing device as set forth in claim 1, wherein:

the pump is a volumetric piston pump having a cylinder and a piston moving reciprocally within the cylinder; and further including a transitional link connecting the turbine with the pump and configured to translate a rotational movement from the turbine into a reciprocal liner movement of the piston.

4. The chemical dispensing device as set forth in claim 1, wherein the pump comprises an auger configured to move particulate chemical concentrate from the chemical inlet to the chemical outlet.

5. The chemical dispensing device as set forth in claim 1, wherein the diluent outlet and the chemical outlet are separated from one another and wherein the diluent and the chemical concentrate flow in separate streams to the at least one mixing inlet of the mixing chamber.

6. The chemical dispensing device as set forth in claim 1, wherein the diluent outlet and the chemical outlet are separated from one another and wherein the diluent and the chemical concentrate flow through the vertical gap in separate streams to the at least one mixing inlet of the mixing chamber.

7. A method of diluting and dispensing a chemical concentrate, comprising the steps of:

providing a turbine having a diluent inlet and a diluent outlet, the diluent inlet being configured for direct connection with a supply of pressurized diluent;

providing a pump having a chemical inlet and a chemical outlet, the chemical inlet being configured for connection with a supply of chemical concentrate; and mechanically connecting the turbine with the pump to allow the pump to be driven by operation of the turbine when diluent flows through the turbine;

providing a mixing chamber having at least one mixing inlet and a mixing outlet;

providing a vertical gap separating the diluent outlet from the mixing inlet; and allowing diluent from the diluent outlet of the turbine and chemical concentrate from the chemical outlet of the pump to separately flow into the at least one mixing inlet of the mixing chamber.

8. A chemical dispensing device comprising:

a turbine having a diluent inlet and a diluent outlet;

a pump having a chemical inlet and a chemical outlet, wherein the pump is connected with and actuated by rotation of the turbine;

a mixing chamber having at least one mixing inlet and a mixing outlet;

a vertical gap separating the diluent outlet and the chemical outlet from the mixing inlet;

wherein the diluent inlet is configured for direct connection with a supply of diluent;

wherein the pump inlet is configured for connection with a supply of chemical concentrate; and wherein the diluent is directed through the turbine and the chemical concentrate is directed through the pump and wherein the diluent and the chemical concentrate are subsequently gravity fed through the vertical gap to the at least one mixing inlet of the mixing chamber.

* * * * *